US005335919A

United States Patent [19]

Soong

[11] Patent Number: 5,335,919

[45] Date of Patent: Aug. 9, 1994

[54] MOVABLE END CAP FOR THE HANDLE OF A SPORTS ROCKET

[76] Inventor: Tsai C. Soong, 1839 Jackson Rd., Penfield, N.Y. 14526

[21] Appl. No.: 98,525

[22] Filed: Jul. 29, 1993

[51] Int. Cl.[5] ..... A63B 49/08

[52] U.S. Cl. ..... 273/735; 273/165

[58] Field of Search ..... 273/73 R, 73 J, 75, 273/81 R, 165, 81.6, 81.5, 81 D

[56] References Cited

U.S. PATENT DOCUMENTS

| | | | |
|---|---|---|---|
| 1,804,316 | 5/1931 | Butler | 273/165 |
| 1,997,364 | 4/1935 | Holden et al. | 273/165 |
| 2,223,437 | 12/1940 | Yeager, Jr. | 273/165 |
| 2,780,464 | 2/1957 | Ashley | 273/165 |
| 2,984,486 | 5/1961 | Jones | 273/75 |
| 4,098,506 | 7/1978 | Gaiser | 273/75 |
| 4,185,375 | 1/1980 | Brown | 273/75 X |
| 4,361,326 | 11/1982 | Kokes | 273/810 |
| 4,402,508 | 9/1983 | Pflueger | 273/75 |
| 4,804,181 | 2/1989 | Foster | 273/81 D |
| 5,199,706 | 4/1993 | Chen | 273/75 |

FOREIGN PATENT DOCUMENTS

| | | | |
|---|---|---|---|
| 234689 | 6/1925 | United Kingdom | 273/165 |
| 239706 | 9/1925 | United Kingdom | 273/165 |

*Primary Examiner*—William E. Stoll

*Attorney, Agent, or Firm*—Bernard A. Chiama

[57] ABSTRACT

The invention is for an improvement of a conventional sports racket, especially the tennis racket, and is directed to the end cap on the racket handle. The end cap is made into two parts, one an end closure fixed at the butt end of the handle of the racket. The other part becomes an abutment device which is made from rubber-like material, having a profile similar to the conventional end cap but its inner circumference is less than the circumference of the handle, so that after it is stretched and installed over the handle at a desired location along the axis of the handle, the friction is sufficient to effectively fix the abutment device on the handle. This arrangement provides the support for the hand of the racket user. The rearrangement of the support point of the hand on the handle, changes the balance of the racket and the center of percussion of the racket, and affects the impact power and swinging effort to operate the racket, which is a desirable feature previously not available to players who utilize conventional sports racket.

9 Claims, 3 Drawing Sheets

MOVABLE END CAP FOR THE HANDLE OF A SPORTS ROCKET

BACKGROUND OF THE INVENTION

In sports racket, especially the tennis racket, where a relatively long handle is provided, the conventional way of construction of the handle is having the unfinished handle cut to the required length at the butt end, insert and fix a plastic end cap to the end and having a grip tape wrapped over the entire handle, including the end cap. The end cap possesses an enlarged neck, larger in its diameter than the trunk of the handle, which provides a firm support for the palm of the hand, preventing the racket slipping out of the hand due to the centrifugal force created during swinging of the racket. Since the torque required to swing the racket depends on the mass moment of inertia of the racket with respect to the gripping point, the location of the hand hold is important, but a player can not rearrange the end cap once he had the racket. The invention improves the design of the end cap such that it is no longer fixed at the butt end of the handle. He can easily move the gripping point to a preferred position.

DESCRIPTIONS OF THE DRAWINGS

DESCRIPTIONS OF THE PREFERRED EMBODIMENTS

Figure 1:
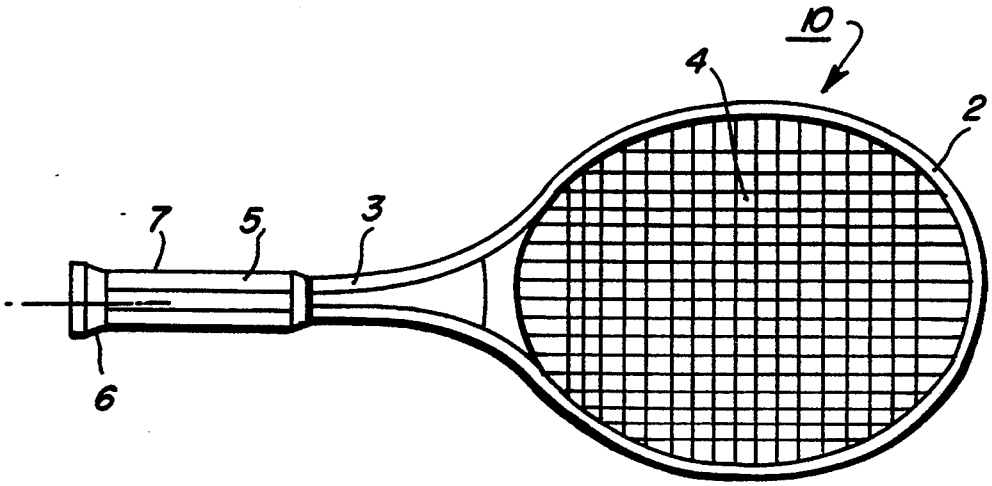
FIG. 1 PRIOR ART
FIG. 1 shows a conventional tennis racket.

FIG. 1 shows a conventional tennis racket 10 whose frame comprising a head 2, with shank 3, supporting a string network 4 in between. The shank extends into the handle portion 5 to form a core, hollow or solid. An end cap 6, providing end closure and support to the hand. A grip tape 7 provides cushion and friction for the hand to hold, is wrapped over the entire length of 5.

Figure 2:
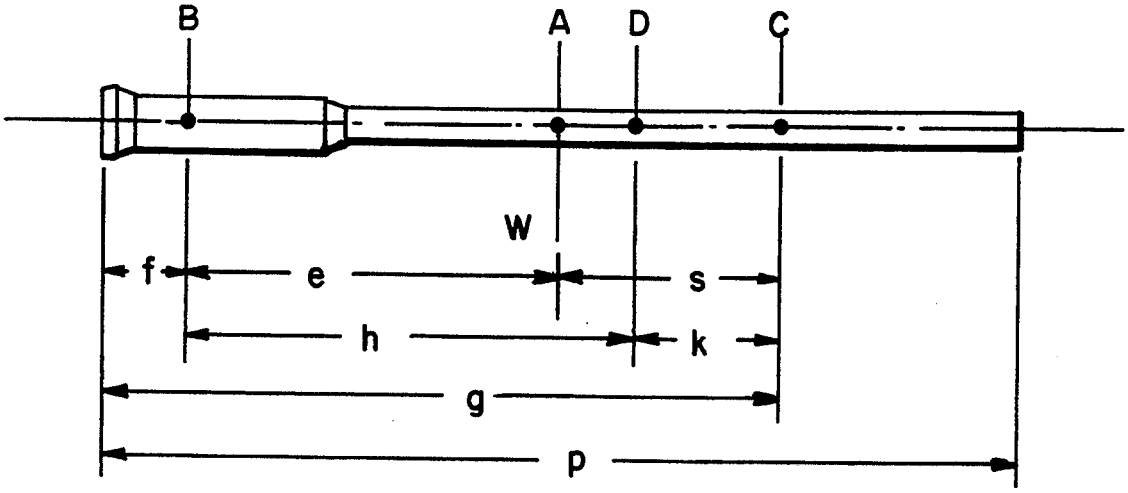
FIG. 2 PRIOR ART
FIG. 2 shows various structural points along the axis of the racket.

FIG. 2 shows the side view of FIG. 1 where the weight of the racket W is centered at A, point B is the grip point, which is the center position of the palm holding the handle 5. Point C is the center of the string network, and point D is the center of percussion of the racket. When a rigid rod is moving translationally in a direction perpendicular to the axis, it is moving as if all its mass is concentrating at its center of gravity, such as A. But when it is moving both translationally and rotationary with point B as a pivot, just as a tennis racket is being swung, it would move as if all its mass is concentrating at a point D farther down the axis which is called the center of percussion in physics. If the racket hits the ball at D, the hand at B will not feel any impact at all. That is why it is called center of percussion. If D is close to the center of the network 4, it would be the ideal case. The distance h depends on where is the point B. If B is near the butt end of the handle, the torque required to swing the racket is large and the player could be easily tired. However, the impact force to the ball would be great. On the other hand, if B is made closer to the head, it takes less torque to swing the racket, but the strike would be less powerful. It is desirable if a user can have options to move the grip point B in relation to the center of gravity as well as to the center of percussion. But in a conventional racket, the end cap 6 is both a closure of the handle as well as a fixed grip point to support the hand. The palm of the hand is always centered at about 7 cm to the butt end of the conventional end cap.

The invention eliminates the conventional end cap and divide it into an end closure and a grip device. The end closure remains at the end of the handle for cosmetic purpose and the grip device is made to be able to detach and reinstall at any point along the handle as preferred by the player.

For a conventional tennis racket, W in FIG. 2 is about 340 g, f is 7 cm, e plus f is called balance, is about 32 to 34 cm, which makes e, if 34 cm is taken, about 27 cm, length p is about 68 cm and g is about 51 cm. That makes s about 17 cm. The center of percussion, h, is calculated from the following equation:

$$h=(m^2+e^2)/e \tag{1}$$

where m is the radius of gyration of the racket,about its center of gravity. For an approximate estimate of the conventional racket, one may take $m^2=p^2/12$. The quantity $(m^2+e^2)$ is the square of the radius of gyration of the racket about B. We shall refer to B as the grip point. The torque required to swing the racket by holding it at B is linearly proportional to $(m^2+e^2)$.

The ratio of the effort to swing the racket about the grip point B, at different values of e, as compared with the maximum e at 27 cm, is a useful information, $$R=(m^2+e^2)/(m^2+27^2) \tag{2}$$

If the grip point B is rearranged to move closer to the center of gravity A, the effect on the shifting of the center of percussion, shown by the value of k, which denotes the closeness of the center of percussion to the geometric center of the network, and also the swinging force ratio R, may be estimated in Table 1:

TABLE 1 k and R corresponding to different e values

| f | e | h | k | R |
|---|---|---|---|---|
| 7.0 | 27.0 | 41.3 | 2.7 | 1.0 |
| 8.0 | 26.0 | 40.8 | 2.2 | .96 |
| 9.0 | 25. | 40.4 | 1.6 | .90 |
| 10.0 | 24.0 | 40.1 | 0.9 | .86 |
| 11.0 | 23.0 | 39.8 | 0.2 | .83 |

Table 1 shows k and R values for decreasing e values. It shows that by moving the grip point closer to the gravity center brings the percussion center much closer to the geometrical center of the network. Also, the effort of swinging the racket is reduced. For example, move the grip point 4 cm. towards the throat, the percussion center D is almost coinciding with the center of the string network C, and the torque to swing the racket is reduced to 83% of the conventional grip. Both are desirable for a tennis instructor who has to swing the racket many times in giving lessons. However, the power to smash the ball which is inversely proportional to R has a 17% reduction. This may not be so desirable for a young pro who does not mind to swing the racket very hard as long as he overpowers his opponent. The invention which enables a player to rearrange the position of the grip point along the handle should have a great appeal to many players.

Figure 3:
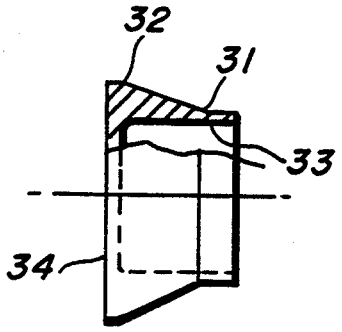
FIG. 3 PRIOR ART
FIG. 3 and 3A show a conventional end cap and its side view respectively.
Figure 3A:
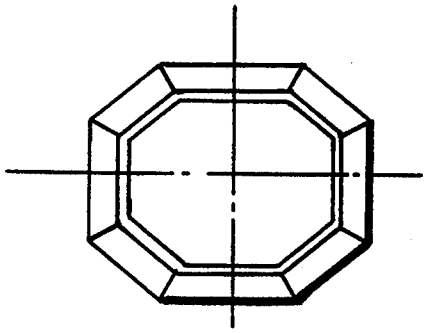
FIG. 3A PRIOR ART

FIG. 3 and 3A are end cap configuration of prior art. There is an abutment device 31 which is tapered and culminated at its highest point 32. The hollowed inner contour 33 fits the exterior contour of the finished handle. The end cap has an end closure 34 which is the butt end of the racket.

Figure 4:
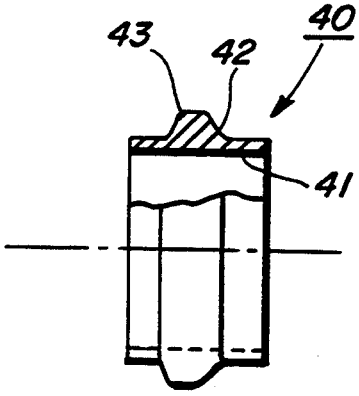
FIG. 4 and 4A show a preferred embodiment of the invention and its side view.
Figure 4A:
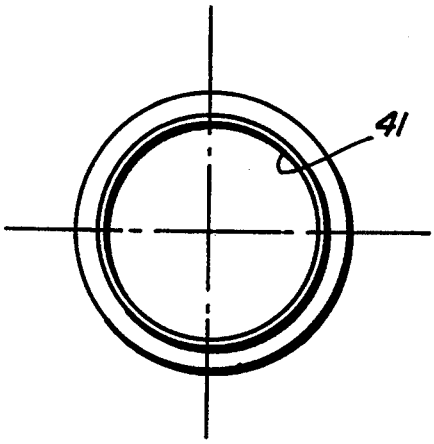

FIG. 4 shows a preferred abutment device 40, and FIG. 4A is the side view. The material of the abutment device is preferred to be stretchable, like rubber. It is an endless band whose inner circumference 41 is less than the outer circumference of the finished handle. It can be put on by stretching and it naturally follows the contour of the cross sectional shape of the finished handle. The hoop stress produced by stretching will create interface compressive force towards the handle. The resulting friction enables the abutment device to stick to the handle at the preferred new grip point on the handle without slipping.

The abutment device has a taper 42 which culminates to a high ridge 43. The tapered portion and the ridge will form a supportive inclined surface to support the palm of the holding hand. The abutment device is held to the handle by friction as said, or by stapling it to the handle, or by other means. The conventional grip tape which covers the surface of the main portion of the handle may also wrap the shoulder device if the shoulder device is slipped onto the handle before the grip tape is wrapped over the handle. But it is preferred that the grip tape is wrapped over the handle from end to end first, making it a finished handle having the end closure, before the abutment device is installed.

Figure 5:
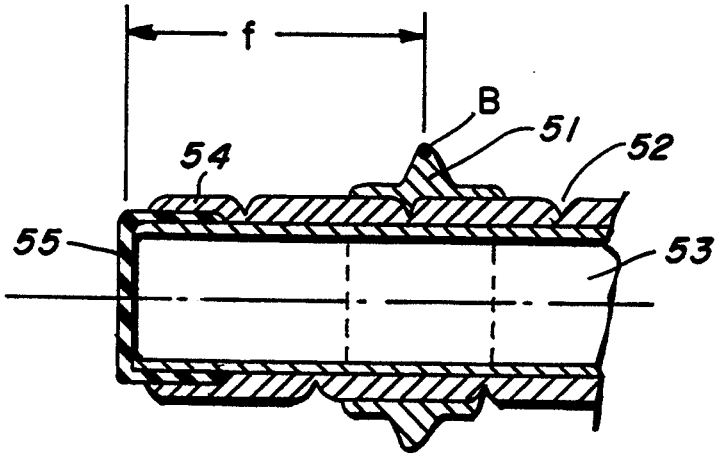
FIG. 5 shows a preferred handle assembly of the invention.

FIG. 5 shows an abutment device 51 installed on a finished handle assembly 52. The handle assembly comprises a cylindrical or polygon sectioned core 53, hollow or solid, a grip tape 54 and an end closure 55. The grip tape 54 may extend over the whole length of the handle assembly or stopped short at the edge of the end closure. The abutment device may be anchored at any point of the handle assembly at a distance f as defined in FIG. 2A and its position is fixed by friction, stapling, or other means. Said means may include some hard spikes associated with the inner surface of the abutment device, pointing inwardly towards the outer surface of the grip tape and sink into the grip tape for anchor.

Figure 6:
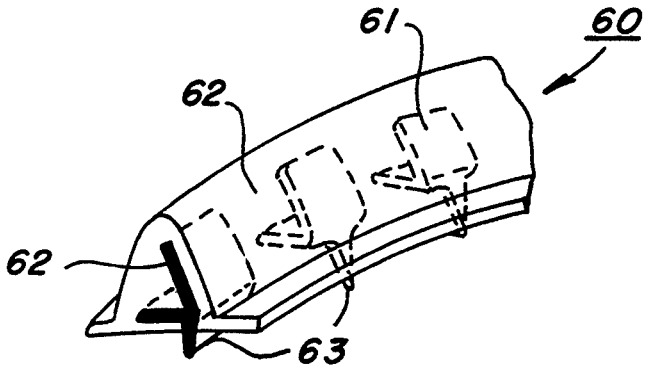
FIG. 6 shows a preferred composite shoulder device.

FIG. 6 shows a further improvement of an abutment device 60. It is a composite abutment device, comprising hardened pieces 61, such as plastic or metal, arranged in order and lined up along the circumference, imbeded in rubber, or other suitable elastic media, to form a composite elastic band 62 where the band provides circumferential elongation necessary for installation while the hard pieces supply the stiffness to back up the inclined surface of the abutment to support the hand. Spikes 63 may be provided to bite into the grip tape of the handle for further support. This improvement is significant because the compressive force the palm of the hand of the user pressing against the inclined surface of the abutment device for support during play is very large. It often crushed the conventional end cap even though it is stapled onto the handle. Tests with this invention had shown that frictional force to hold the abutment device in place from the hoop tension may not be sufficient when the player is a very hard hitting pro. The abutment device may slip under such demanding situation.

In summary, the invention contains four innovative ideas. The first one is to suggest that the conventional end cap unchanged and unquestioned for so long may be improved finally. The breakthrough of a psychological tradition is difficult. An inquisitive mind and a through understanding of the mechanics are necessary. The second is to have retained the conventional arrangement for user friendliness purpose: a conventional gripping tape covering the conventional core, having the new abutment device fixed on a conventional finished handle. In this way, nothing is changed too much in the conventional way of holding a racket. The third innovation is the simplicity in using an elastic band whose inner circumference is less than the outside circumference of the finished handle and friction from the hoop stress is used to anchor the band on the handle. The fourth idea which further improves the performance significantly is to have a composite band: the required stretch is supplied by the rubber-like band, the back up strength of the abutment is fortified by the hard pieces imbeded inside the band and then spikes is provided for a firm hold. Other details may change but the innovative features should characterize the invention.

What is claimed is:

1. A sports racket having a frame including a head portion and a shank region supporting a string network, and a handle assembly, the shank region connecting the frame to the handle assembly, the handle assembly comprising, a handle portion connecting the handle assembly to the shank region, and including a gripping means for the hand of a user, an abutment device detachably arranged on the handle portion and along the circumference thereof, said abutment device having a ridge member projecting outwardly from the surface of the handle portion for supporting the hand of the user at a predetermined point thereon, said abutment device being a composite having a plurality of rigid elements embeded in an elastic media and being arranged with said elements ringing around the circumference of the handle portion, said elastic media being stretched around said circumference thereby enabling said abutment device to be positioned over the handle portion at said predetermined point along the central axis.

2. The sports racket as defined in claim 1, wherein said abutment device encircles the handle portion is positioned at a predetermined point along the axis of the handle portion, and provides means for preventing the abutment device from slipping on the handle portion.

3. The sports racket as defined in claim 1 wherein said abutment device is made of plastic material and its inner contour has the same shape as the shape of the cross-section of the handle part.

4. The sports racket as defined in claim 1 wherein said handle portion further comprising an end closure device, functioning as a cap arranged for closing the end of the handle portion opposite to the end of the shank region.

5. The sports racket as defined in claim 1 wherein said handle part comprises at least a gripping tape wrapped over the outer surface of the handle portion.

6. The sports racket as defined in claim 5 wherein said gripping tape is wrapped at least over a part of the surface of said abutment device.

7. The sports racket defined in claim 5 wherein the inner circumference of said abutment device is outside the outer surface of the gripping tape.

8. The sports racket as defined in claim 1 wherein said inner circumference of said abutment device has sharp edge devices pointing radially inward for biting into the outer surface of the handle portion for increasing holding of the same and preventing sliding thereof.

9. The sports racket as defined in claim 1 is a tennis racket.

* * * * *